US005533321A

United States Patent [19]

Hooper et al.

[11] Patent Number: 5,533,321

[45] Date of Patent: Jul. 9, 1996

[54] METHOD AND APPARATUS FOR WRAPPING, CRIMPING AND HEADING PAPER ROLLS AT A SINGLE STATION

[75] Inventors: Steven C. Hooper, Hoquiam; Jon E. Skjonsby, Aberdeen, both of Wash.

[73] Assignee: Lamb-Grays Harbor Co., Hoquiam, Wash.

[21] Appl. No.: 512,818

[22] Filed: Aug. 9, 1995

[51] Int. Cl.[6] ..... B65B 61/00

[52] U.S. Cl. ..... 53/415; 53/136.2; 53/211; 53/465; 53/372.9

[58] Field of Search ..... 53/136.2, 372.9, 53/211, 465, 415, 214, 491

[56] References Cited

U.S. PATENT DOCUMENTS

| | | | |
|---|---|---|---|
| 1,764,081 | 6/1930 | Jones et al. . | |
| 1,840,222 | 1/1932 | Brown | 53/136.2 |
| 1,871,765 | 8/1932 | Williamson | 53/136.2 |
| 2,644,282 | 7/1953 | Irvine | 53/64 |
| 2,674,074 | 4/1954 | Lancaster et al. | 53/64 |
| 2,803,935 | 8/1957 | Gibson | 53/380 |
| 3,290,861 | 12/1966 | Prager | 53/214 |
| 3,342,014 | 9/1967 | Prager | 53/214 |
| 3,393,492 | 7/1968 | Lamon et al. | 53/137 |
| 4,303,462 | 12/1981 | Karr | 156/538 |
| 4,534,151 | 8/1985 | Schneck et al. | 53/415 |
| 4,679,376 | 7/1987 | Ekblom | 53/137 |
| 4,744,198 | 5/1988 | Hood et al. | 53/415 |
| 5,003,753 | 4/1991 | Dornblaser | 53/415 |

FOREIGN PATENT DOCUMENTS

| | | | |
|---|---|---|---|
| 1275440 | 8/1968 | Germany | B65B 25/14 |
| 2838862 | 3/1979 | Germany | B65B 25/14 |
| 2038759 | 7/1980 | United Kingdom | B65B 59/00 |
| 2197842 | 6/1988 | United Kingdom | B65B 11/04 |

*Primary Examiner*—John Sipos
*Assistant Examiner*—John Paradiso
*Attorney, Agent, or Firm*—Seed and Berry

[57] ABSTRACT

A method and apparatus for applying a wrapper to a paper roll, a turret mechanism has a crimper and an inside head holder on one side and an outside head applying platen on the opposite side, a drive for rotating the turret mechanism to place the crimper and inside head holder adjacent the paper roll end to place an inside head on the paper roll and crimp the wrapper over the inside head, and then rotating the turret mechanism to place the outside head applying platen adjacent the paper roll to place an outside head over the crimped wrapper all at a single station. The inside head holder has several retractable vacuum cups that can also apply positive air pressure to hold the inside head against the roll and during crimping. The vacuum cups are sequentially, independently retracted as a crimp approaches to clear the crimp as the paper roll is rotated.

12 Claims, 6 Drawing Sheets

METHOD AND APPARATUS FOR WRAPPING, CRIMPING AND HEADING PAPER ROLLS AT A SINGLE STATION

TECHNICAL FIELD

This invention relates to methods and apparatuses for packaging a paper roll using body wrap and, in particular, to performing the crimping and heading functions at a single station using a rotary turret for selectively presenting the header or the crimper to the face of the end of the paper roll.

BACKGROUND OF THE INVENTION

Paper roll wrapping, crimping, and heading apparatus have in general placed the head on the end of the roll and the wrapper around the roll at different locations along a transport path. This invention is the result of an effort to combine all these roll packaging operations in a single station, as well as to provide flexibility in configuration for a roll-through layout, automatic head placement and ability to handle non-self-supporting packaging materials. Some roll wrapping apparatus has performed these operations at a single station but in a manner that was inefficient and precluded the wrapped roll from being passed on through the wrapping station under an overhead wrapper backstand.

As is also well known, a paper roll R is customarily wrapped with a heavypaper. This wrapper is wound off one of the wrapper supply rolls by attaching, usually by gluing, the forward end of the wrapper onto the paper roll and then rotating the paper roll to pull the desired layers of wrapper onto the roll. The width of the wrapper will usually be wider than the length of the roll so that the wrapper can be folded or crimped over the end of the roll. A small lightweight inside head is sometimes placed first against the end of the roll, and a heavier outside head is placed over the end of the roll and over the crimped end of the wrapper. The lighter weight inside head is sometimes eliminated or may be either a heavier self, form-sustaining disk or a flexible non-self-supporting head used primarily for weather sealing the end of the roll. As will be noted the flexible-type inside head is difficult to place on the roll with automated equipment because it must be held against the end of the roll while the overhanging end of the wrapper is crimped over the inside head and the end of the roll.

SUMMARY OF THE INVENTION

It is an object of this invention to provide a single station wrapper, crimper and header for rolls wherein the wrapped roll can be passed on through the station under overhead wrapper supply rolls or passed back out of the station in the direction from which it was delivered.

It is another object of the invention to provide an apparatus that mounts a crimper on one side of a rotary turret and a head applying platen on the other side of the turret so that the crimping and heading operations can be performed on the roll at a single station in an efficient manner.

It is another object of the invention to provide a method of applying a wrapper, a crimp and an inside or outside head or both an inside and outside head to the paper roll by placing the wrapper on the roll, crimping the wrapper with one side of a rotary turret while loading a head ready for application on the other side of the turret, rotating the turret and placing the head onto the roll end while the crimper is rotated to the other side of the turret out of the vicinity of the roll.

These objects are best achieved by mounting a crimper on one side of a rotary turret at a wrapping station, mounting an outside head platen to the opposite side of the turret and providing means for rotating the turret between opposite rotational locations with the crimper or the head platen facing the end of the roll. Two such turrets and corresponding crimpers and head platens are located on opposite sides of the wrapping station so that both ends of the wrapper can be crimped and heads applied at one station.

The advantages of this apparatus and method are that while the head platen is out of the way of the crimper, all operations can be performed at one station, and the turret can be rotated to position the head platen or the crimper at the ends of the roll in a quick and efficient manner and allow placement of inside and outside heads automatically. In addition, the platen and the crimper are more easily removed from the path of the completely wrapped and headed paper roll whether the paper supply rolls are at ground level or are above the wrapper station. This gives the customer more versatility so that the roll can be removed from the wrapping station either from the direction it was delivered before being wrapped or in a continuation of its delivery direction out the opposite side of the wrapping station, depending on the customer's desired configurations.

It is another object of the invention to place an inside head onto the end of a roll by holding the head with suction and subsequently pressing the head against the end of the roll using positive air pressure to form an air cushion to hold the head onto the roll. This object is applicable to inside heads that are of substantial rigidity, such as heavy cardboard heads, or to lightweight non self-supporting end covers or heads, that may be thin and used for weather protection beneath an outside head.

This object is obtained by holding the inside head to the end of the roll with vacuum applied by a group of vacuum cups that hold the head concentric with the axis of the roll, and subsequently during crimping of the overhanging wrapper over the end of the roll, press the inside head onto the roll end by applying positive air pressure through the vacuum cups to press the head against the end of the roll with an air cushion so that the roll can be rotated and the wrapper crimped while the head continues to be pressed against the end of the paper roll.

DETAILED DESCRIPTION OF THE INVENTION

Figure 1:
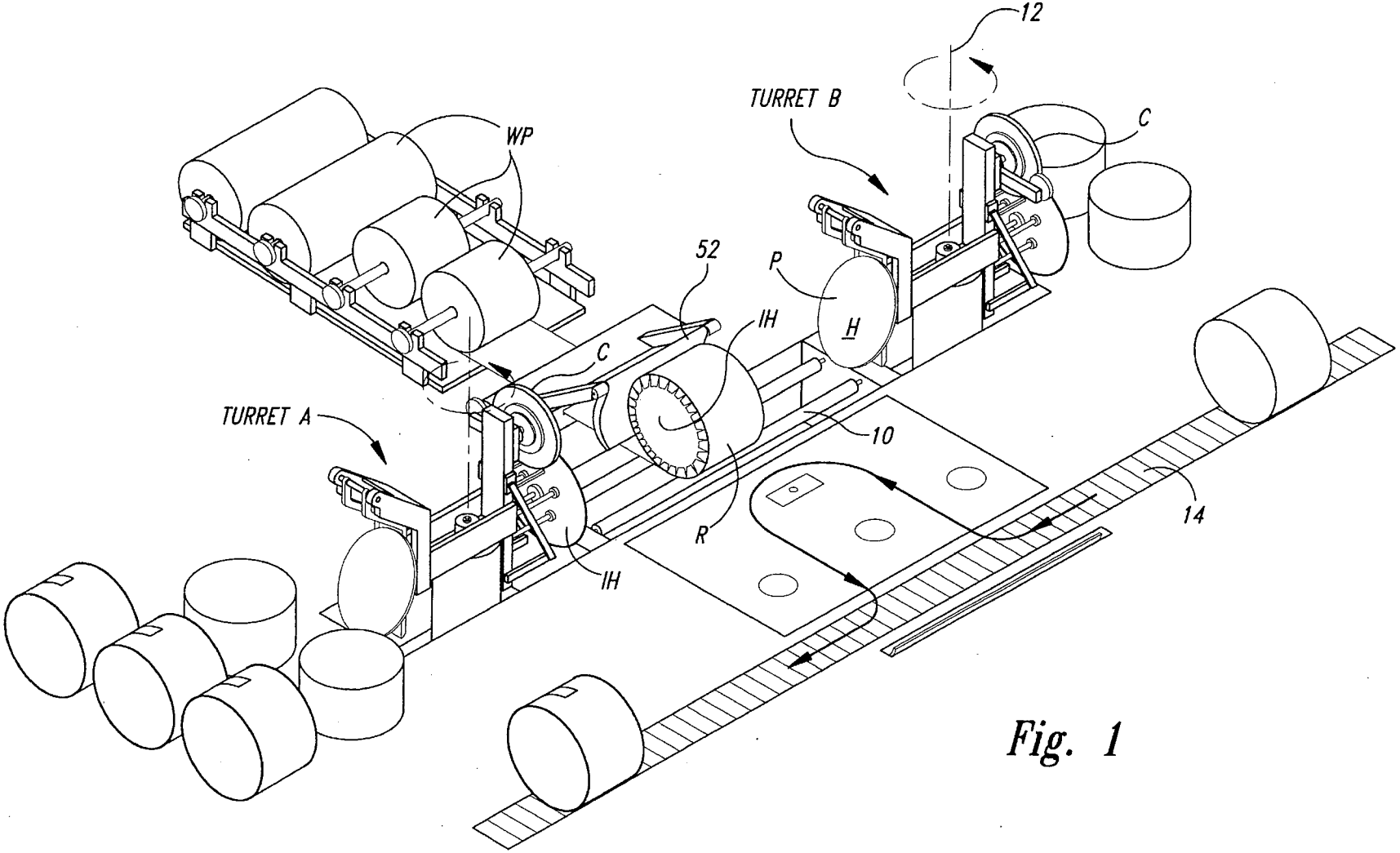
FIG. 1 is an isometric of a single station wrapping system embodying the principles of the invention.
Figure 2:
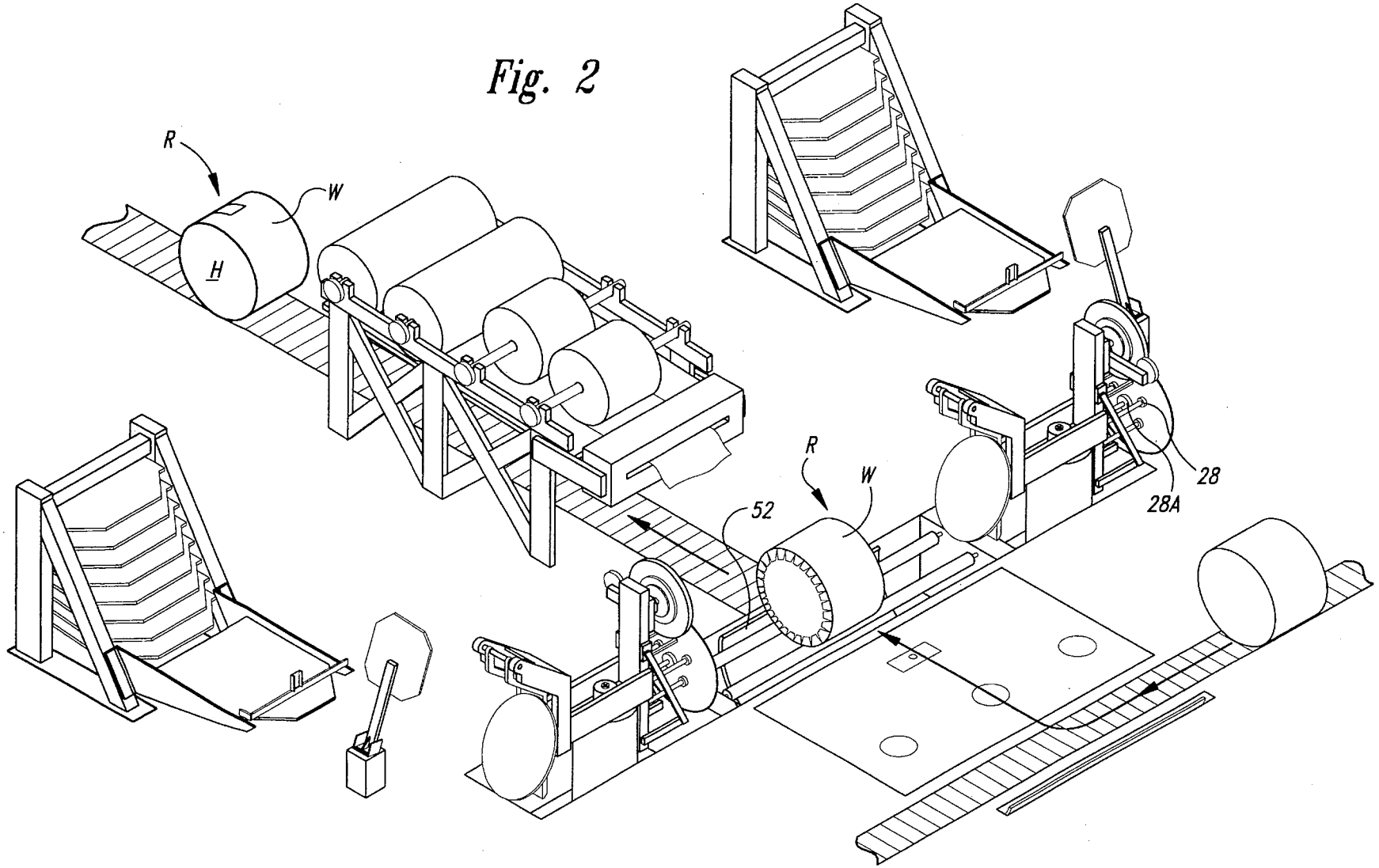
FIG. 2 is an isometric of a second embodiment of single station wrapping system embodying the principles of the invention.
Figure 3:
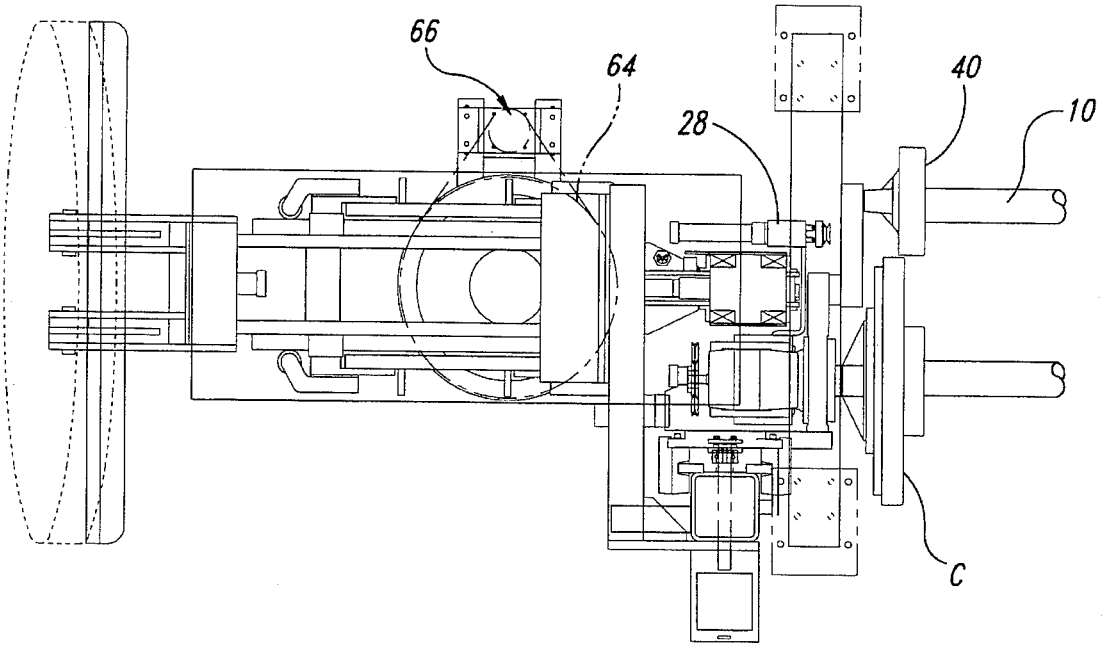
FIG. 3 is a fragmentary plan view of the invention.
Figure 6:
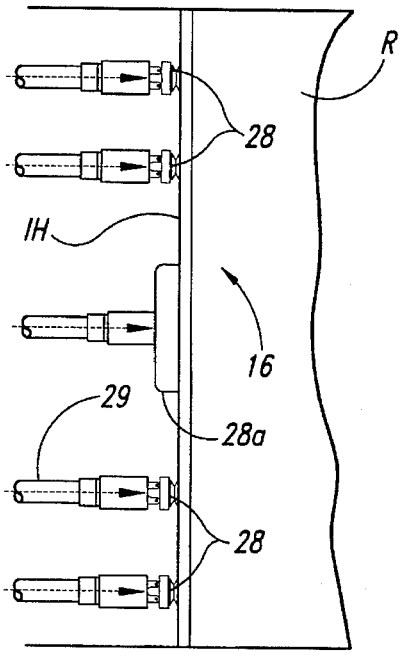
FIG. 6 is a schematic fragmentary front elevation of inside head applying vacuum cups.
Figure 7:
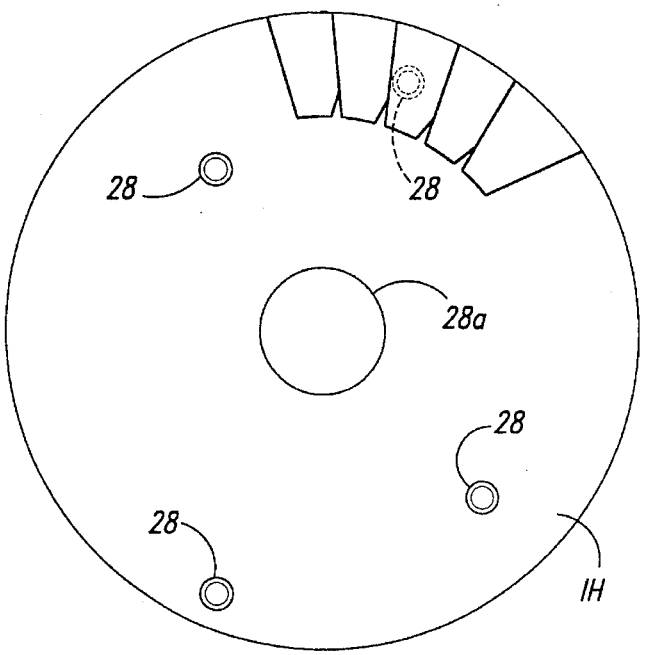
FIG. 7 is a schematic side elevation of the cups in FIG. 6 showing a sequence of retraction of the cups.

As best shown in FIG. 1 the single station wrapping, crimping and heading apparatus includes powered rollers 10, for rotatably supporting a paper roll R to be wrapped. At each end of the rollers are turrets A and B. Since the turrets provide the same functionality, only one turret will be described. Each turret has a conventional crimper C and a head platen P located on the opposite side of the turret from the crimper. As will be described the turret can rotate about a vertical axis 12 to present either the crimper or the head platen to face the end of the roll. Beyond the rollers 10 are a series of wrapper supply rolls WP. As is well understood, the wrapper supply rolls supply wrapper of different widths so as to wrap different width paper rolls. In FIG. 1 the wrapper supply rolls are at ground level whereas in the embodiment of FIG. 2 the wrapper supply rollers are overhead allowing a discharge path for removing the wrapped paper roll out the rear side of the station. In addition, the embodiment of FIG. 2 provides for automatic selection, delivery and placement of inside and outside heads to the vacuum cups, 28 and 28*a*, and outside head platen P as described in more detail in the specification and in U.S. Pat. No. 4,744,198.

In the embodiment of FIG. 1 a paper roll R to be wrapped enters from conveyor 14 and is placed onto the rollers 10, is wrapped and headed, and returned back to the conveyor. In the embodiment of FIG. 2 the paper roll is moved onto the rollers from the conveyor but after being wrapped and headed is discharged out through the rear of the station beneath the overhead wrapper supply rolls. This turret arrangement of the head platen and the crimper uniquely provides for this versatility in the discharge path of the wrapped roll and more easily accommodates the possible installations available to the customer.

Figure 4:
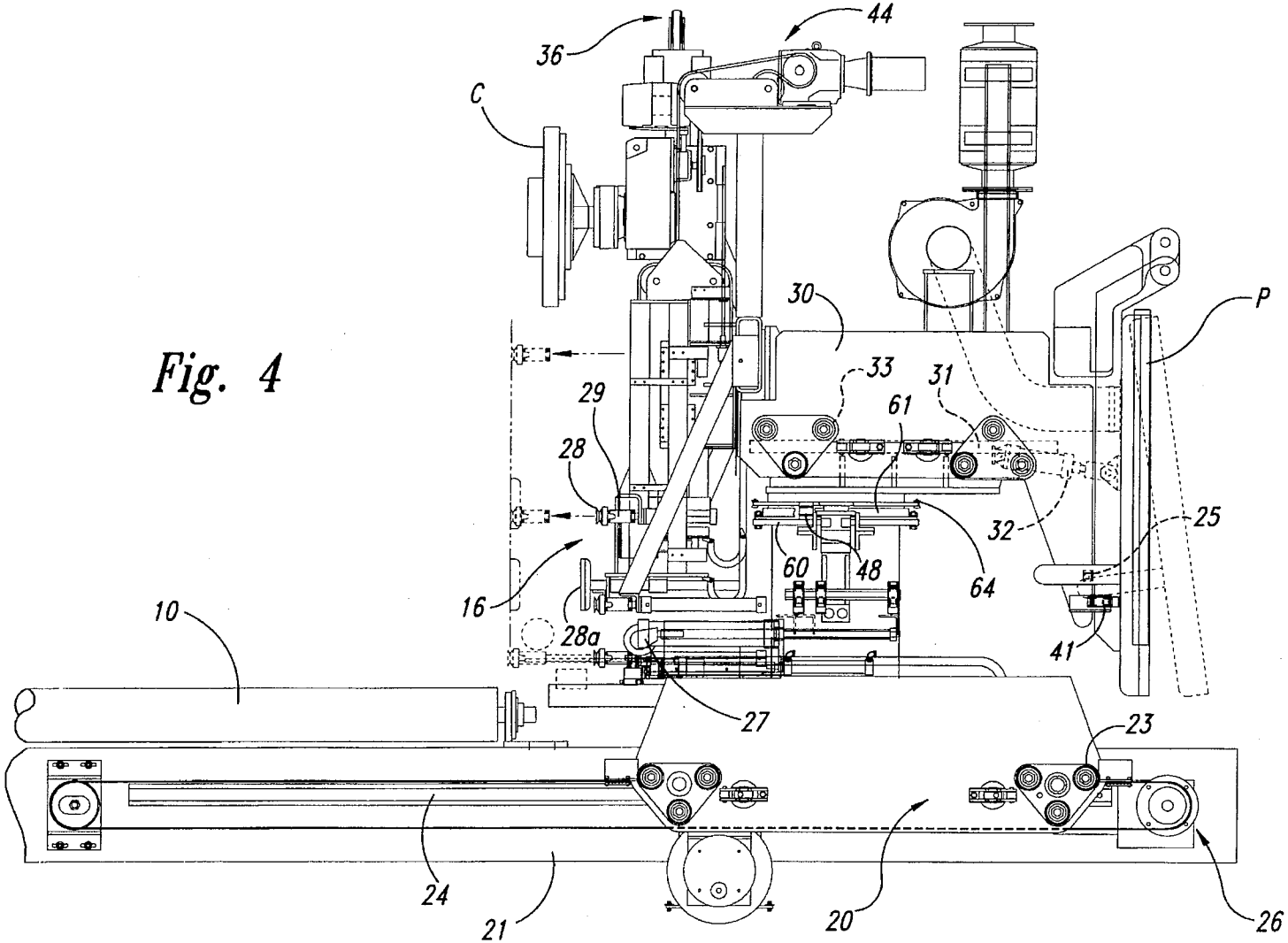
FIG. 4 is a fragmentary front elevation of the invention.
Figure 5A:
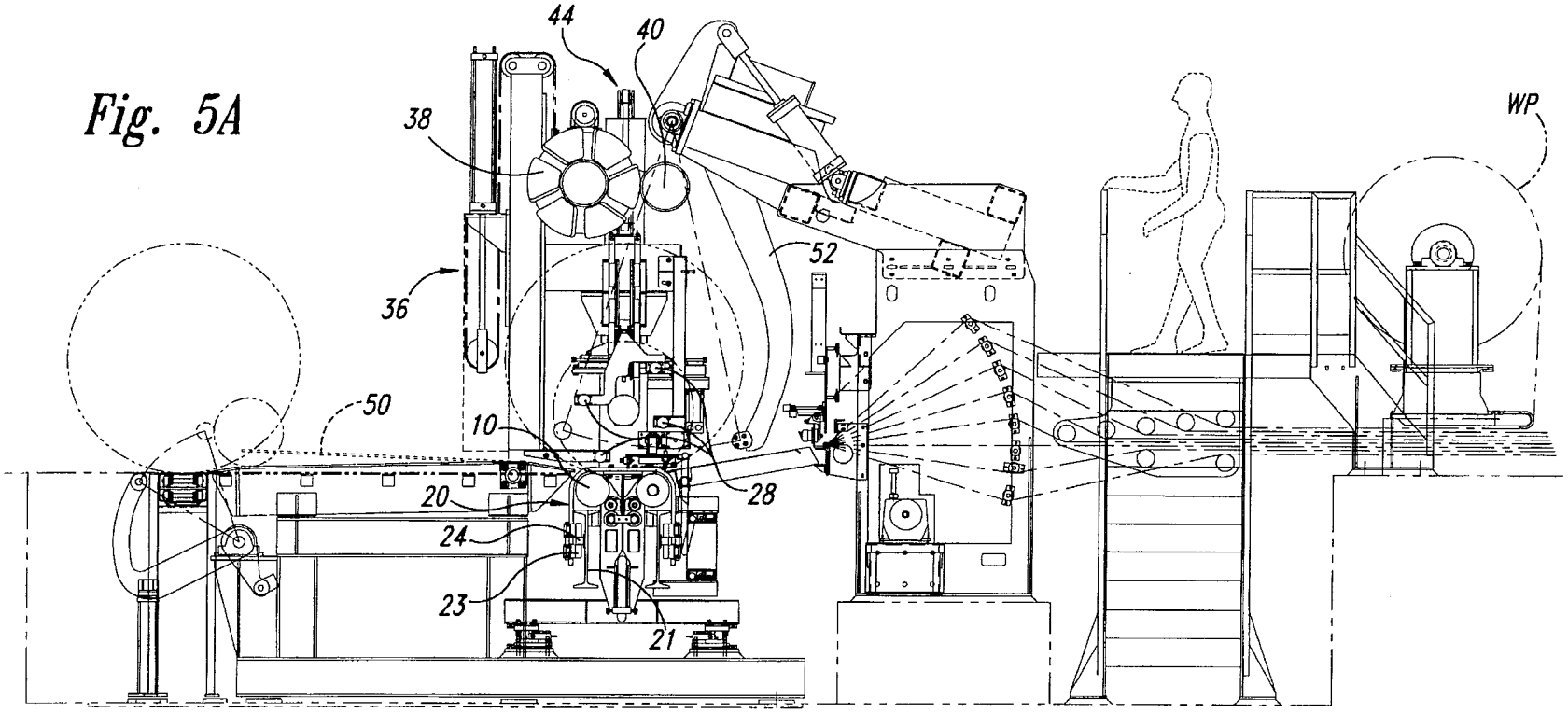
FIG. 5A is a side elevation of the invention.

The turret has a turret carriage 20 provided with channels 21 [FIG. 5A] that mount cam rollers 23. The cam rollers ride along rails 24 that allow the turret carriage to be moved to the left and right as viewed in FIG. 4. The carriage is moved by a conventional belt drive powered by a motor and drive sprocket 26. The motor is an electric motor with a drive controller. The motor moves the carriage at a first speed to bring the head platen P or the crimper C close to the end of the paper roll. An inside head holder 16 uses a plurality of vacuum cups 28 and 28*a* each mounted on the head holder with its own independent extendible air cylinder 29.

Figure 5B:
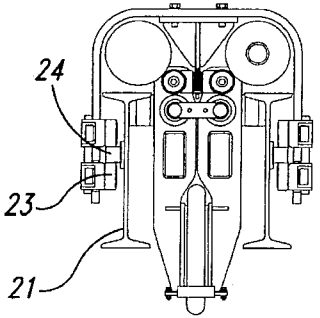
FIG. 5B is a fragmentary detail.
Figure 8:
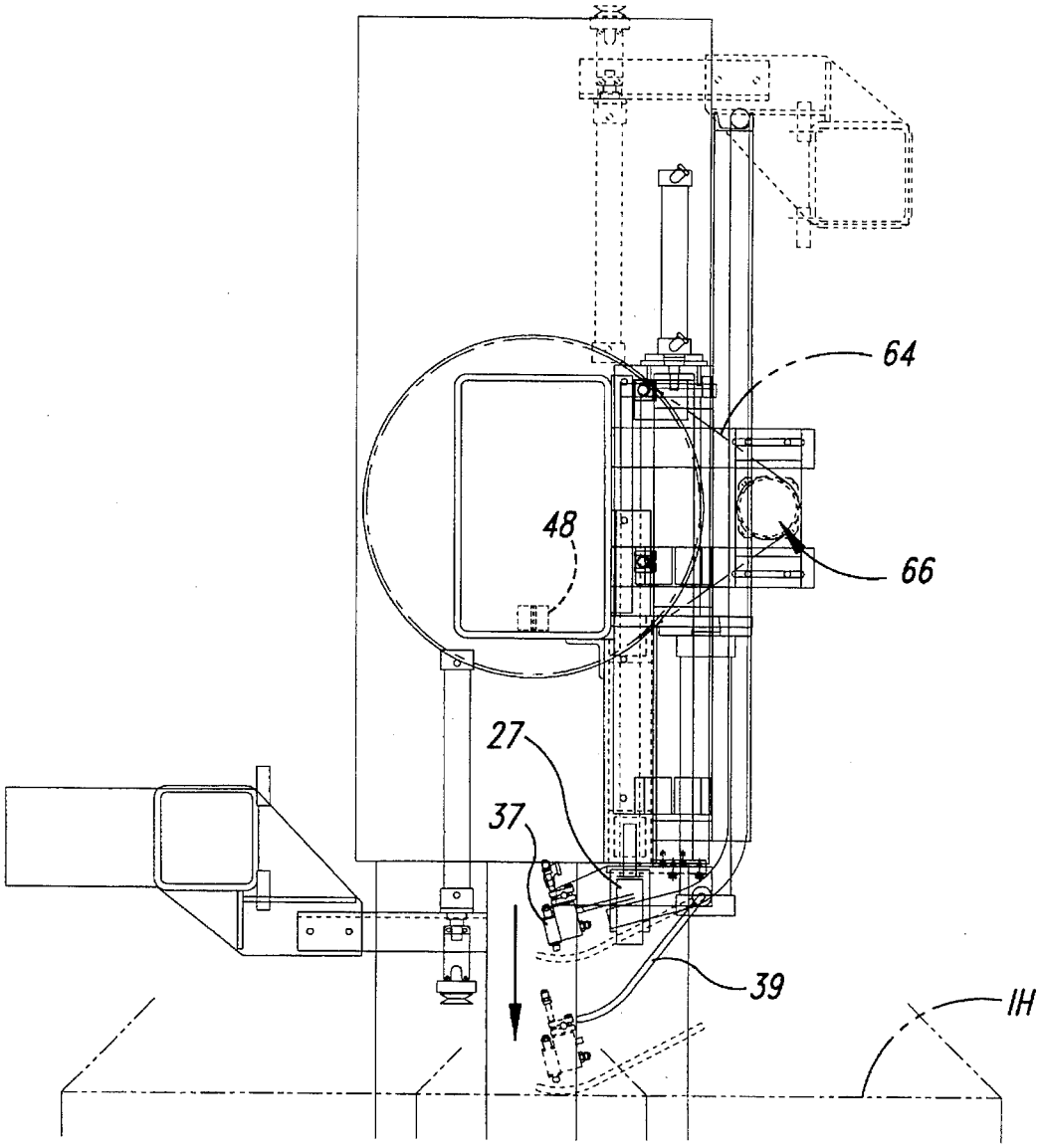
FIG. 8 is a schematic plan view.

With the crimper positioned facing the paper roll and assuming the wrapper is on the roll, the crimper C is lowered from above the roll R by a cylinder and belt arrangement 36 (FIG. 5) that lifts the crimper when the rod of the cylinder is retracted and allows the crimper to lower by gravity when the rod is extended. The backstop 48 locks the turret against rotation.

The crimper is conventional and includes a plurality of crimper paddles 38 that slide against the overhang wrapper to fold it to the roll end when the crimper paddles are rotated as a unit about a horizontal axis. A crimper offset rider roll 40 is positioned adjacent the crimper paddles and rides on the upper surface of the paper roll as the crimper paddles are rotated against the end of the roll. The rider roll assists in holding the paper roll down against the rollers 10 while the crimp is being made.

If the inside head IH is placed on the roll end before the wrapper is put on the roll, the crimper remains elevated, the suction cups air supply is reversed to apply positive pressure and the paper roll rotated while the wrapper paper is applied on the paper roll.

As best shown in FIG. 4, a motor and belt arrangement 44 moves the inside head holder 16 up and down to position a vacuum cup 28*a* concentric with the center of the paper roll to be wrapped. The inside head holder also is provided with additional vacuum cups 28 individually mounted on extendible pneumatic cylinders 29 and are located in a pattern to hold a nonsupporting head to the roll end. A center vacuum cup 28*a* is movable vertically at a 1:2 ratio to the cups 28 to be positioned in the center of the inside head. Each vacuum cup can be retracted independently during the crimping.

When an inside head is to be placed on the roll end, the inside head holder 16 is lowered to be concentric with the axis of the roll. The turret carriages move to the roll end to pin the head in position. The turret carriage is moved toward the roll quickly at a fast speed and then at creep speed until a pneumatic cylinder mounted roller 27 is forced to retract, actuating a switch to stop the carriage. The vacuum cups remain extended to engage the inside head and press it against end of the roll.

In preparation for the crimping process, the crimper paddle carriage shown in FIG. 5A is lowered to rest on the circumference of the paper roll. The vacuum in the vacuum cups is then replaced with a positive air pressure holding the inside head against the end of the roll by an air cushion. This allows the paper roll to be rotated with the crimper paddles folding the overhanging wrapper over the end of the roll. As the roll rotates the vacuum cups are sequentially retracted just in advance of the crimped wrapper folds so that vacuum cups will not engage or tear the crimped wrapper folds. As stated above, the inside head can be placed against the roll either prior to adding the wrapper to the roll or after the wrapper is on the roll by placing the inside head on the roll inside the overhanging wrapper.

The ability of the head cups to apply vacuum to hold the inside head against the roll and then to use positive pressure to create an air cushion or bearing to hold the head on the roll while the crimp is being made and the roll is rotated is a unique feature and offers the advantage of supporting the head no matter how lightweight or flexible the head may be. This application is to be distinguished from attempting to flush the entire head with air. In this application, discrete elements ride on an air cushion or bearing to support the head. Additionally, this application is not limited to discrete vacuum cups but may encompass independently operational circumferential segments of larger head holding devices. The function of the air cushion or bearing is to allow discrete elements to maintain points of pressure against the head to allow friction between the head and the end of the roll to prevent movement of the head relative to the roll.

The turret is provided with a lower bearing plate 60 fixed to the carriage 20 and an upper rotatable bearing plate 61, supported by bearings in a conventional manner. The upper bearing plate has a sprocket 64 driven by a motor and chain 66. The turret carriage 20 is provided with a backstop 48 to hold the turret rigid against rotation while crimping. As described earlier, when an outside head H is being pushed against the roll, however, the backstop 48 is not used so that as the head platen P engages the roll end, the turret is free to rotate slightly to assure that the platen and thus the outside head is squared-up or placed flat against the end of the crimped roll. When the crimper is positioned against the roll end, the backstop 48 is engaged so that the crimper is always accurately located relative to the paper roll.

The carriage with the head platen facing the paper roll and a head H on the platen after advancing quickly to a position about 450 mm from the roll end then can be reduced to a slow or creep speed to bring the head platen into contact with the end of the roll.

When the head platen P shown in FIG. 4, is rotated on a vertical axis against the end of the roll, the bottom end of the platen is pushed against the end of the roll until the platen is moved from the tilted position shown in phantom lines into the vertical position shown in solid lines. A photo switch 25 is triggered when the platen begins to move to the vertical position. If the paper roll is off center on the roller 10, the switch will be triggered prematurely and the carriage will decelerate to creep speed immediately. In either case, the carriage continues to move in until an inductive proximity switch 41 is activated to indicate the head platen is fully retracted due to full contact with the roll end, and the carriage is stopped.

At this time a subcarriage 30 then moves the platen toward the roll, a short distance applying a holding force pushing the head on the platen tightly against the end of the roll. The subcarriage 30 is mounted on rails 31 that are on the rotatable or upper end of the turret. Cam rollers 33 guide the subcarriage in the rollers. As will be described, when applying an outside head H, the roll end will have first been wrapped, crimped and a layer of glue applied to the crimped end of the wrapper so that by holding the head tightly against the roll end, wrapper crimp and glue, the head will become securely glued to the end of the roll.

The glue is applied to the end of the roll and wrapper in a conventional manner by a gluer 37 with a spreading wand 39. While the head is pushed against the roll end the turret can rotate slightly to allow the head to "float" and square-up to the roll end. After a few seconds of dwell time to allow the head to seal, the subcarriage 30 and main carriage 20 are retracted to their out position. The platen is retracted to its vertical position by a cylinder 32, which allows the carriage to be rotated 180° for the next crimping cycle. Other techniques for securing the head to the end of the roll may also be employed.

The operation of the apparatus and method of wrapping the roll, is as follows. A paper roll R is delivered to the rollers 10 in any manner, such as by lifting a tilt table 50 to allow the paper roll to roll by gravity onto the rollers. A cushioning stop bar 52 stops the paper roll. The cushioning stop bar in the embodiment of FIG. 1 then serves to kick the wrapped paper roll back out of the wrapping station. In the embodiment of FIG. 2 the wrapped paper roll will be kicked out the opposite direction by any conventional roll kicker device and the cushioning stop bar 52 will be replaced with a different conventional cushioning stop.

While the preferred form of the invention has been illustrated and described it should be understood that variations will be apparent to one skilled in the art. For example, heads H could be manually placed on the head platen P as in FIG. 1 or the heads could automatically be retrieved from a set of racks and placed on the platen with a head transfer arm as in FIG. 2. Also, the inside head IH could be applied directly to the roll end before the wrapper is applied, or placed into the overhanging wrapper "tube" after the wrapper is applied to the paper roll. Accordingly, the invention is not to be limited to the specific embodiments illustrated and described.

While the wrapper is usually placed on the paper roll at the same station as the heading and crimping location, it is also apparent that the unique turret-mounted crimper and header can be used where the wrapper is placed on the roll at an earlier location or station. Furthermore, while the wrapper is usually crimped over the head, it is also possible that the outside head can be crimped over the wrapper when desired.

We claim:

1. A single station crimping and heading apparatus for crimping and heading a roll of paper having a wrapper thereon, comprising:

a set of rotatable rollers for supporting a wrapped roll of paper to be crimped and headed;

turret mechanisms at opposite ends of said set of rollers;

said turret mechanisms having two sides, a crimper on one side of said turret mechanism and a head applying device on the second side of said turret mechanism; and means for rotating said turret mechanisms for crimping when said one side faces said set of rollers and for applying a head to the end of the paper roll when said second side of said turret mechanism faces said set of rollers.

2. The apparatus of claim 1, including means located at ground level for placing a wrapper on the paper roll and further including means for delivering a paper roll to the set of rotatable rollers, said delivery means moving a paper roll to the set of rollers and then removing a wrapped paper roll out from the set of rollers in the direction opposite to the direction the paper roll was delivered.

3. The apparatus of claim 1, including means located above the paper roll for placing a wrapper on the paper roll, and further including means for delivering a paper roll to the set of rotatable rollers, said delivery means moving a paper roll to the set of rollers and then removing a wrapped paper roll out from the set of rollers in the same direction as the direction the paper roll was delivered.

4. The apparatus of claim 1, including racks having different size heads, a transfer arm for moving a selected head from the rack to the head applying device on the turret.

5. The apparatus of claim 1, including an inside head holder having a plurality of head holding vacuum cups, an air supply for said cups for supplying vacuum and also supplying pressurized air for providing an air cushion to hold an inside head against the paper roll as the paper roll is rotated.

6. The apparatus of claim 1, said turret mechanism including a carriage movable toward and away from said rollers, a motor for moving the carriage, said carriage motor having a first speed of movement and a second slower speed of movement.

7. The apparatus of claim 6, said crimper including positioning drive for lowering and raising the crimper relative to the rollers.

8. The apparatus of claim 7, including an inside head holder having a plurality of head holding vacuum cups, and means for lowering and raising said inside head holder to position the inside head holder relative to said rollers.

9. The apparatus of claim 8, including backstop means for locking said turret mechanisms selectively against rotation.

10. The method of placing a wrapper and outside head on the ends of a roll of paper at a single station, comprising:

moving a paper roll to be wrapped to a wrapping and heading station having a turret mechanism located at opposite ends of the paper roll, said turret mechanism having a crimper on one side thereof and an outside head applying platen on the opposite side thereof;

applying a wrapper to the paper roll leaving an overhanging wrapper to be crimped;

crimping the overhanging wrapper;

rotating the turret mechanism to deliver an outside head to the roll end while moving the crimper away from the roll end by rotating the turret mechanism, and placing the outside head.

11. The method of claim 10, said side of the turret mechanism having the crimper also having an inside head holder, and further including holding an inside head to the roll inside the overhanging wrapper, first with a vacuum and then with a positive air pressure as the overhanging wrapper is crimped.

12. A single station crimping and heading apparatus for wrapping and heading a roll of paper, comprising:

a set of rotatable rollers for supporting a roll of paper to be wrapped;

a wrapper applicator adjacent the rotatable rollers;

a turret mechanism at each opposite end of said set of rollers, said turret mechanisms having two sides, a wrap crimper on one side of said turret mechanism and a head applying device on the second side of said turret mechanism; and a turret rotator which rotates said turret mechanism to crimp the wrapper when said one side of said turret mechanism faces said set of rollers and to apply a head to the end of the paper roll when said second side of said turret mechanism faces said set of rollers.

* * * * *